US008146558B2

(12) United States Patent
Clouse et al.

(10) Patent No.: US 8,146,558 B2
(45) Date of Patent: Apr. 3, 2012

(54) AUTOMATIC CHOKE FOR AN ENGINE

(75) Inventors: Max W. Clouse, Watertown, WI (US); Thomas G. Guntly, Hartford, WI (US); Mel O. Lux, Fond du Lac, WI (US); Michael B. Busateri, Milwaukee, WI (US)

(73) Assignee: Briggs & Stratton Corporation, Wauwatosa, WI (US)

( * ) Notice: Subject to any disclaimer, the term of this patent is extended or adjusted under 35 U.S.C. 154(b) by 600 days.

(21) Appl. No.: 12/190,721

(22) Filed: Aug. 13, 2008

(65) Prior Publication Data

US 2009/0044777 A1 Feb. 19, 2009

Related U.S. Application Data

(60) Provisional application No. 60/964,577, filed on Aug. 13, 2007.

(51) Int. Cl.
*F02D 41/06* (2006.01)
*F02N 11/00* (2006.01)

(52) U.S. Cl. ..... 123/179.18; 123/179.29

(58) Field of Classification Search ..... 123/179.18, 123/179.28, 179.29
See application file for complete search history.

(56) References Cited

U.S. PATENT DOCUMENTS 2,263,849 A * 11/1941 Mallory ..... 261/39.3
2,684,057 A 7/1954 Bolton
2,926,895 A 3/1960 Seyfarth
3,040,181 A 6/1962 Eiler
3,768,453 A 10/1973 Hurst
3,780,718 A 12/1973 Nambu
3,800,767 A 4/1974 Winkley
3,913,539 A 10/1975 Winkley
3,948,240 A 4/1976 Hirosawa et al.
3,978,835 A 9/1976 Fenton
4,011,844 A 3/1977 Hirosawa et al.
4,114,584 A 9/1978 Rogerson
4,132,211 A 1/1979 Wilfort
4,193,384 A 3/1980 Steiner
4,214,565 A 7/1980 Knapp et al.
4,276,238 A 6/1981 Yoshikawa et al.
4,321,902 A 3/1982 Stoltman
4,344,898 A 8/1982 Takada et al.
4,388,904 A 6/1983 Masaki
4,391,249 A 7/1983 Bianchi et al.
4,463,723 A 8/1984 Tansuwan
4,524,742 A 6/1985 Bonfiglioli
4,563,990 A 1/1986 Kisnida et al.
4,644,919 A 2/1987 Inoguchi et al.
4,662,333 A 5/1987 Martel
(Continued)

FOREIGN PATENT DOCUMENTS

DE 3328277 A1 2/1985
(Continued)

*Primary Examiner* — Hai Huynh
(74) *Attorney, Agent, or Firm* — Rathe Lindenbaum LLP

(57) ABSTRACT

An engine starting assist system configured to be used on an internal combustion engine. The engine starting assist system includes a battery, a choke valve disposed in an air intake of an air/fuel-mixing device, the choke valve having an open position and a closed position, a rotary solenoid powered by the battery, the rotary solenoid having an output shaft, and a bimetal coil. The output shaft of the rotary solenoid is coaxial with the bimetal coil.

25 Claims, 13 Drawing Sheets

U.S. PATENT DOCUMENTS

| | | | | |
|---|---|---|---|---|
| 4,730,589 | A | 3/1988 | Ohtaki et al. | |
| 4,753,209 | A | 6/1988 | Hibino et al. | |
| 4,768,478 | A | 9/1988 | Martel | |
| 4,987,871 | A | 1/1991 | Nisnikawa | |
| 5,031,593 | A | 7/1991 | Erhard et al. | |
| 5,537,964 | A | 7/1996 | Hashiba | |
| 5,660,765 | A | 8/1997 | King et al. | |
| 5,827,455 | A | 10/1998 | Nakai | |
| 6,012,420 | A | 1/2000 | Dykstra et al. | |
| 6,145,487 | A | 11/2000 | Dykstra et al. | |
| 6,932,058 | B2 | 8/2005 | Nickel et al. | |
| 7,628,387 | B1 * | 12/2009 | Clouse et al. | 261/39.1 |
| 2005/0022790 | A1 | 2/2005 | Nickel | |
| 2005/0022798 | A1 | 2/2005 | Roth | |
| 2006/0037574 | A1 | 2/2006 | Matsuda et al. | |

FOREIGN PATENT DOCUMENTS

| | | | |
|---|---|---|---|
| JP | 59136538 | A | 8/1984 |
| JP | 63062982 | A | 3/1988 |

* cited by examiner

AUTOMATIC CHOKE FOR AN ENGINE

CROSS-REFERENCE TO RELATED APPLICATION

The present patent application claims priority to U.S. Provisional Patent Application Ser. No. 60/964,577, titled "AUTOMATIC CHOKE FOR AN ENGINE," filed on Aug. 13, 2007, the entire contents of which is hereby incorporated by reference.

FIELD OF THE INVENTION

This invention relates to choke assemblies for an internal combustion engine. More specifically, the invention relates to an automatic choke assembly for a small engine.

BACKGROUND OF THE INVENTION

In a small internal combustion engine utilizing a carburetor, such as those engines in a lawnmower, a snowblower, or other outdoor power equipment, the engine may include a choke assembly that provides a rich fuel-air mixture for starting the engine and a throttle assembly responsive to the load on the engine. In many small engines, the choke assembly is acutated manually.

In engines having an automatic choke assembly, the choke opening can be controlled by a thermally responsive mechanism. For cold engine temperature conditions, such as when initially starting an engine, the choke valve reduces the air flow to the engine to enrich the air/fuel mixture. For higher temperature conditions, such as after normal engine operation (e.g. for a hot restart of the engine), the choke valve is not needed because the engine no longer requires a rich air/fuel mixture.

SUMMARY OF THE INVENTION

In one embodiment, the invention provides an engine starting assist system configured to be used on an internal combustion engine. The starting assist system includes a battery, a choke valve disposed in an air intake of an air/fuel-mixing device, the choke valve having an open position and a closed position, a rotary solenoid powered by the battery, the rotary solenoid having an output shaft, and a bimetal coil. The output shaft of the rotary solenoid is coaxial with the bimetal coil.

In another embodiment, the invention provides an automatic choke configured to be used on an internal combustion engine, the automatic choke includes a choke valve disposed in an air intake of an air/fuel-mixing device, the choke valve having an open position and a closed position, and an automatic choke module. The automatic choke includes a rotary solenoid powered by a battery, the rotary solenoid having an output shaft, a bimetal coil assembly including a bimetal coil, and a choke arm. The output shaft of the rotary solenoid is coaxial with the bimetal coil.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

Figure 1:
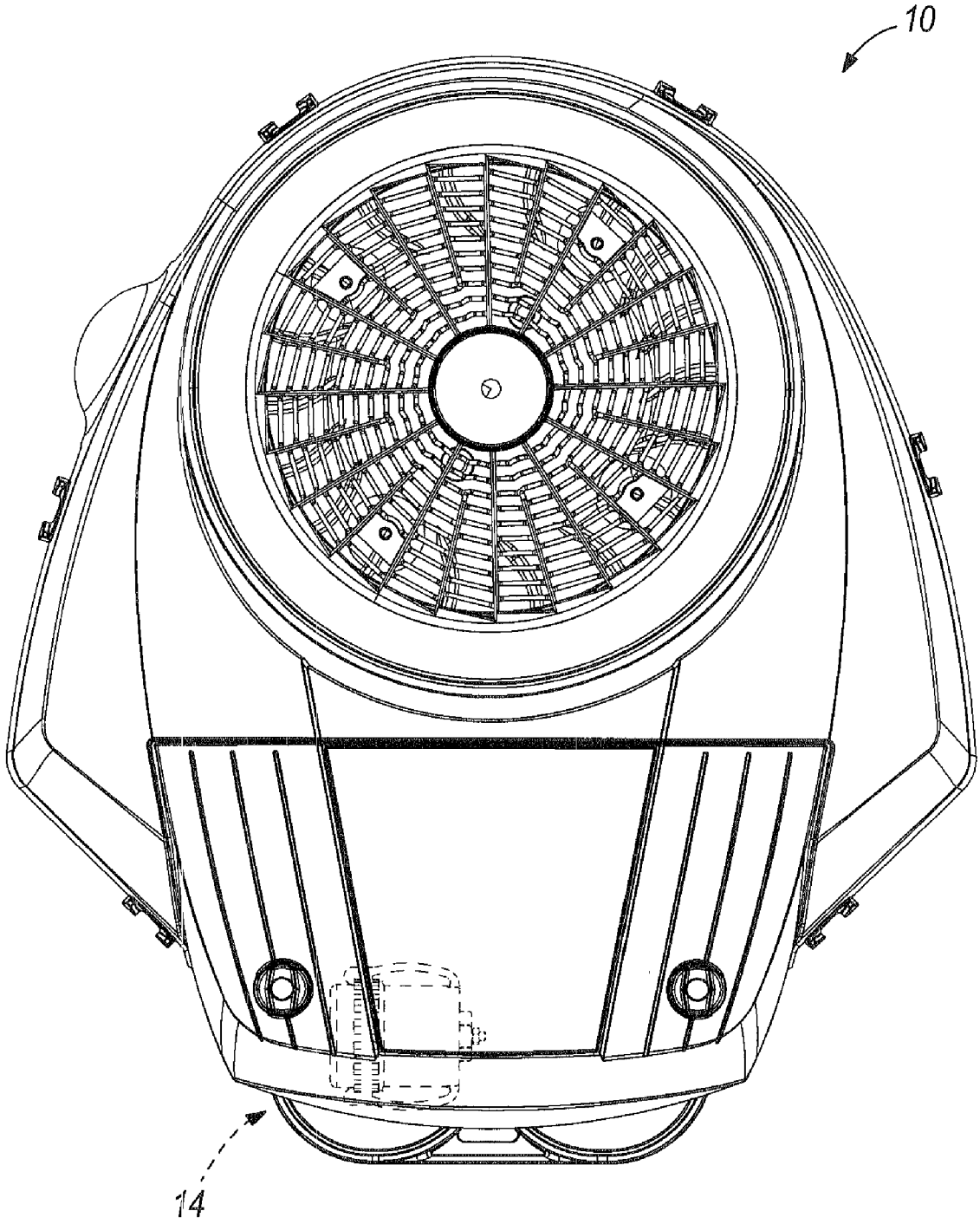
FIG. 1 illustrates an exemplary internal combustion engine having an embodiment of the present invention.
Figure 2:
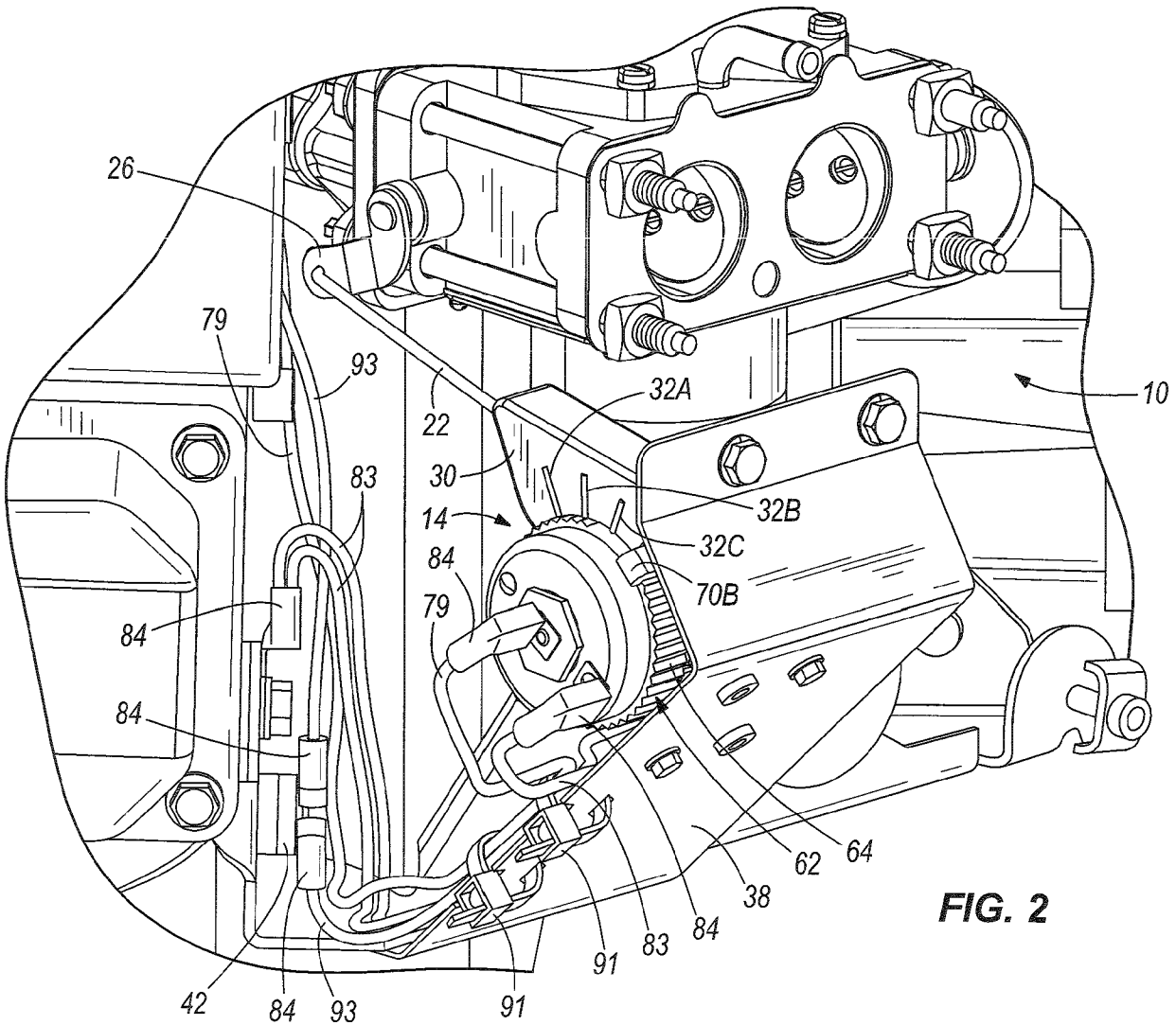
FIG. 2 is a detailed view of the engine of FIG. 1 having an exemplary automatic choke embodying the present invention.

With reference to the drawings, FIG. 1 illustrates an exemplary internal combustion engine 10 that could incorporate the automatic choke of the present invention. As illustrated in FIG. 2, the automatic choke module 14 can be mounted to an engine 10 and linked to a choke valve 18 (FIG. 3) with a choke linkage 22. The engine 10 may further include a mounting bracket 38 configured to couple the automatic choke module 14 to an intake manifold or another part of the engine.

Figure 2A:
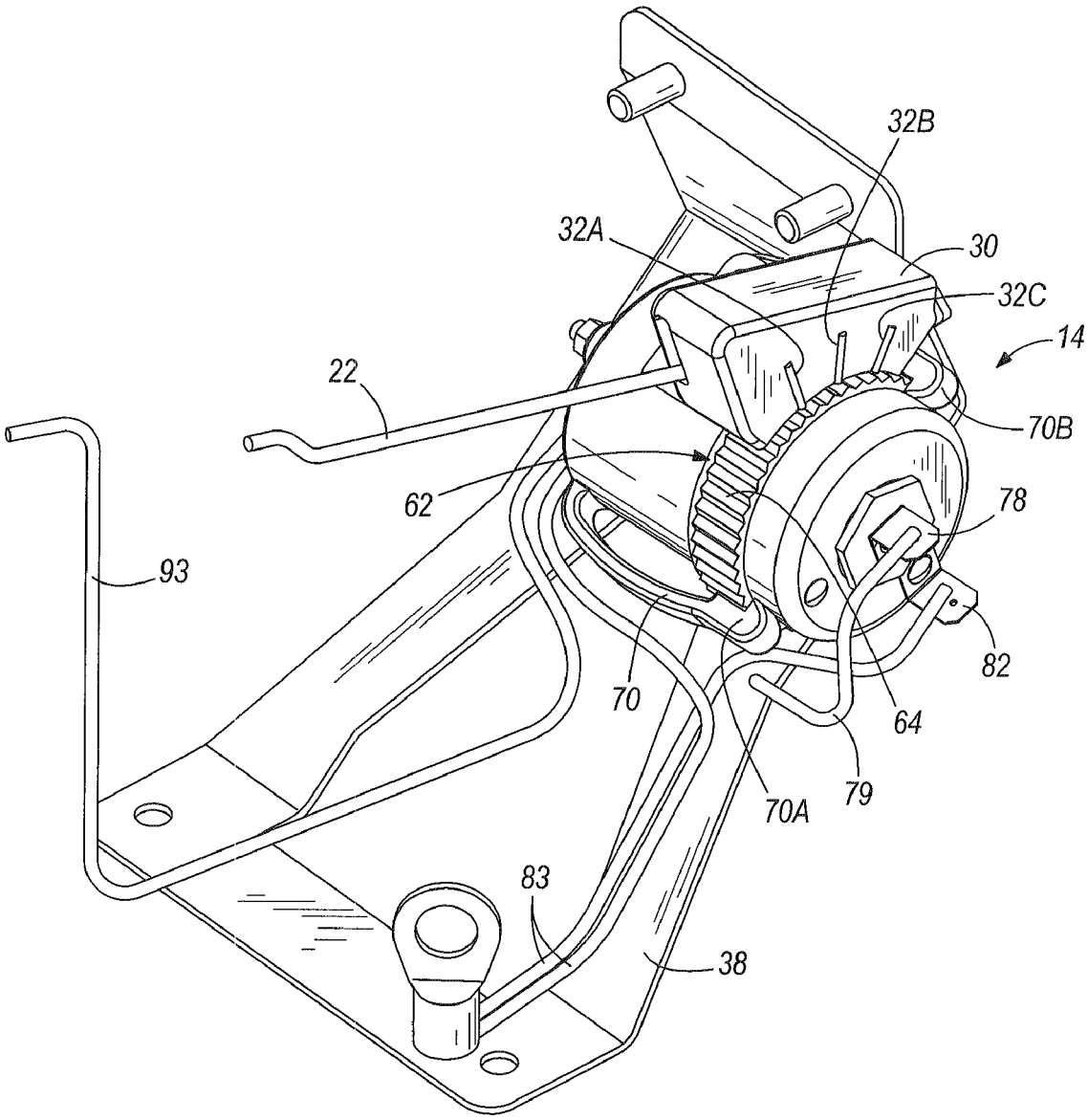
FIG. 2A is a perspective view of the automatic choke of FIG. 2.
Figure 3:
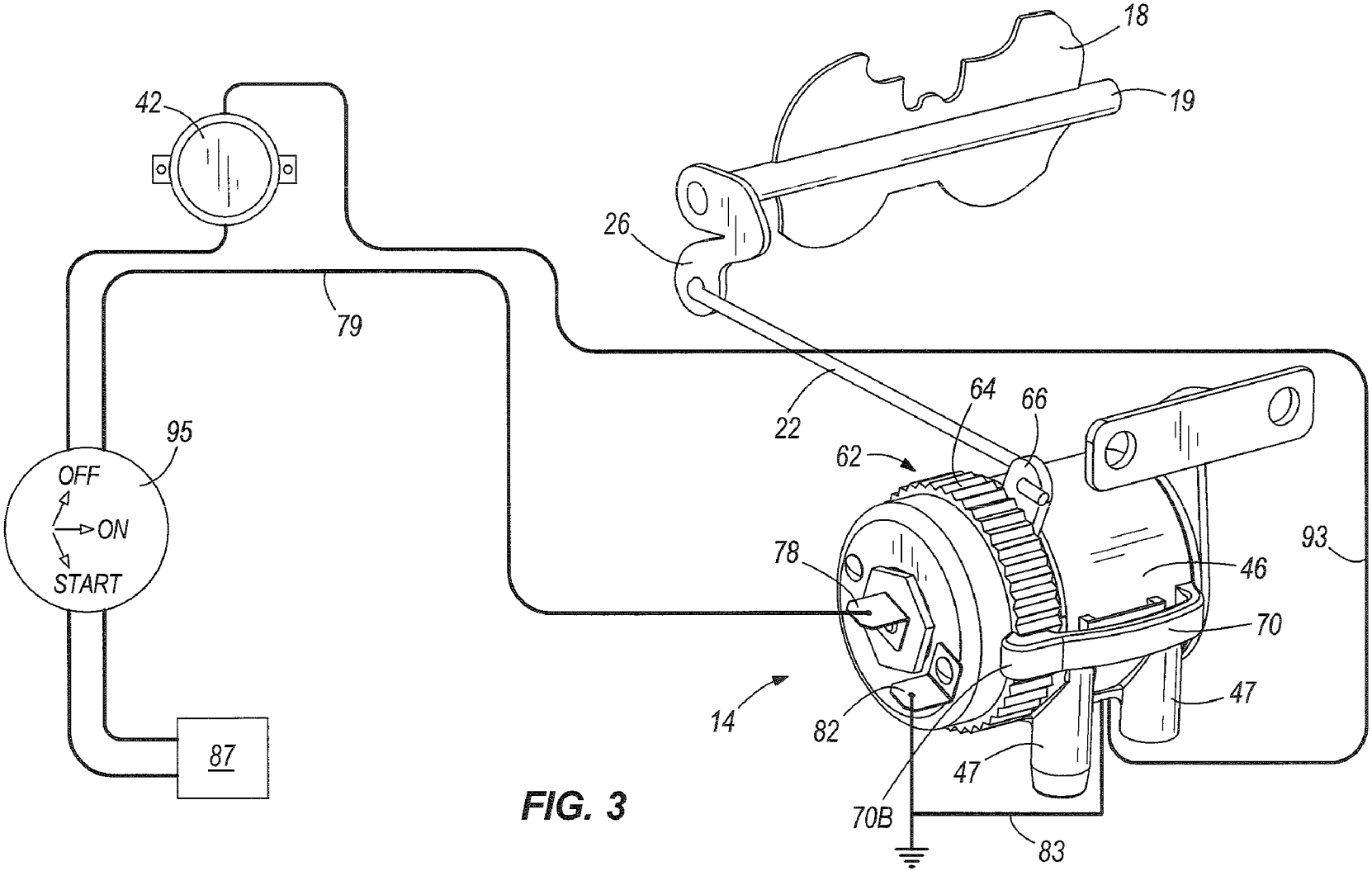
FIG. 3 is a schematic view illustrating the automatic choke in a closed choke state.
Figure 4:
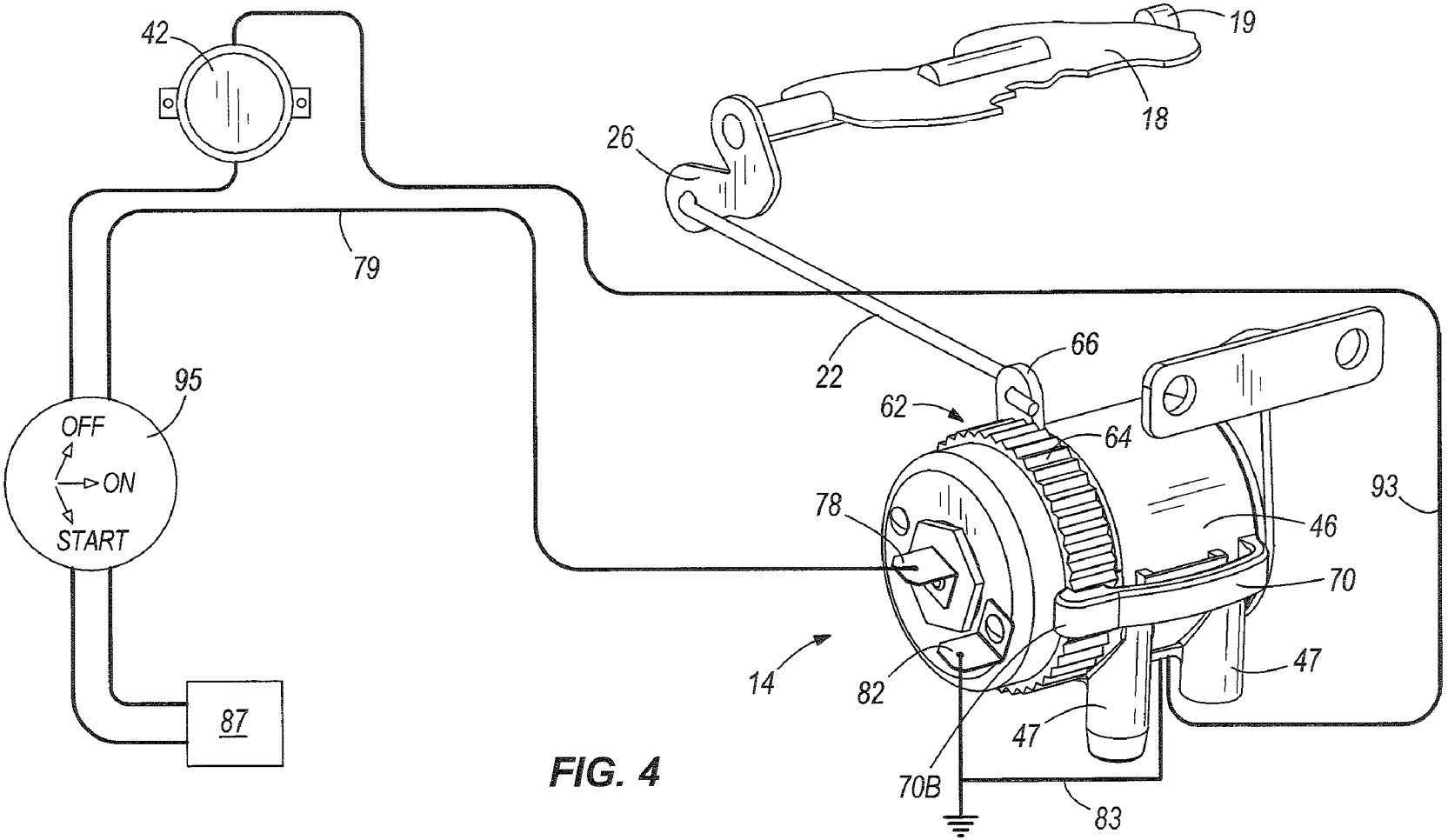
FIG. 4 is a schematic view illustrating the automatic choke in an open choke state.
Figure 5:
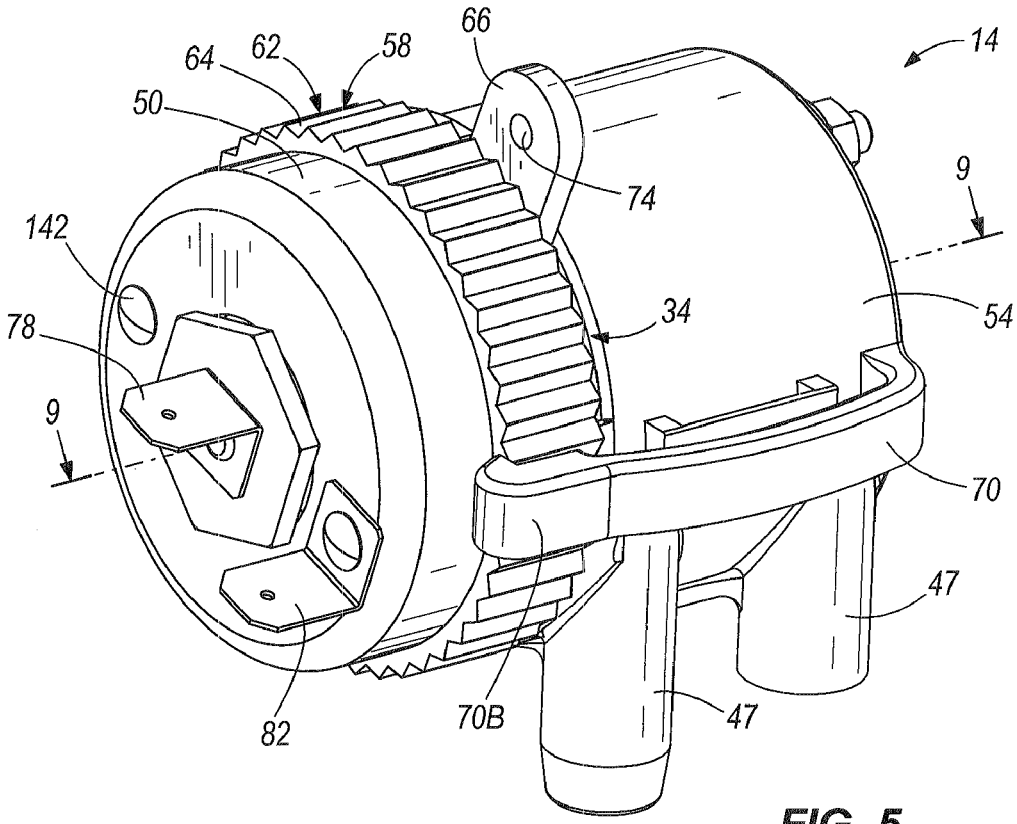
FIG. 5 is a front perspective view of the automatic choke module of FIG. 2.
Figure 6:
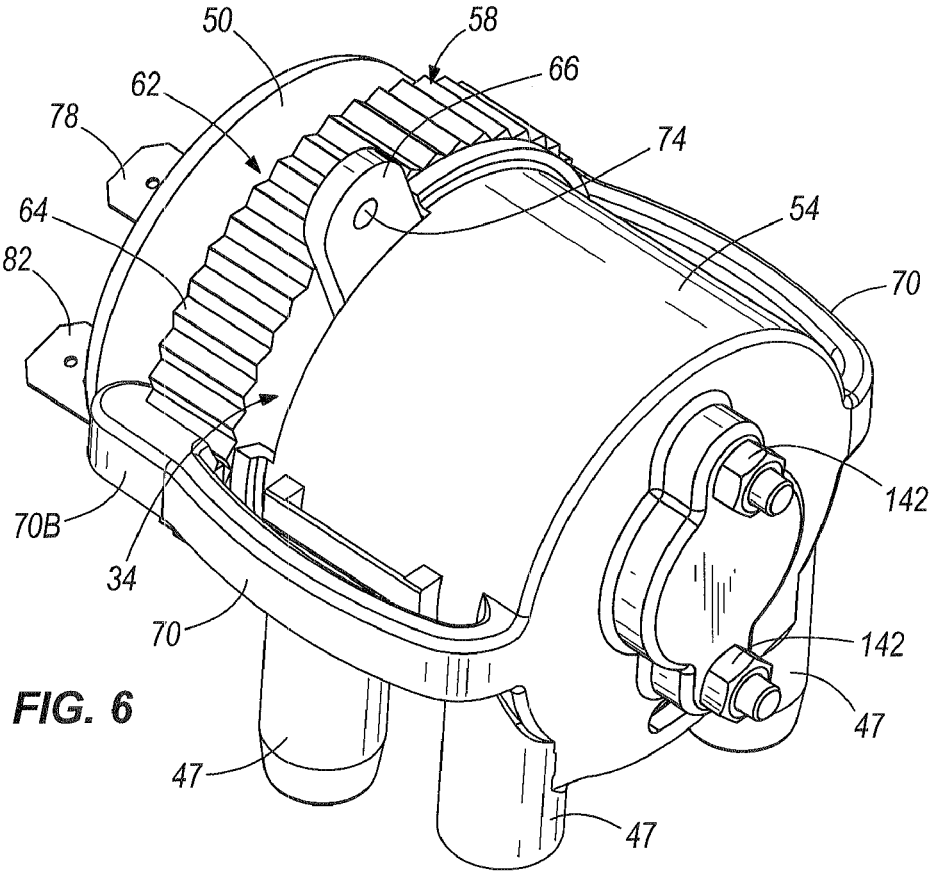
FIG. 6 is a rear perspective view of the automatic choke module of FIG. 2.
Figure 7:
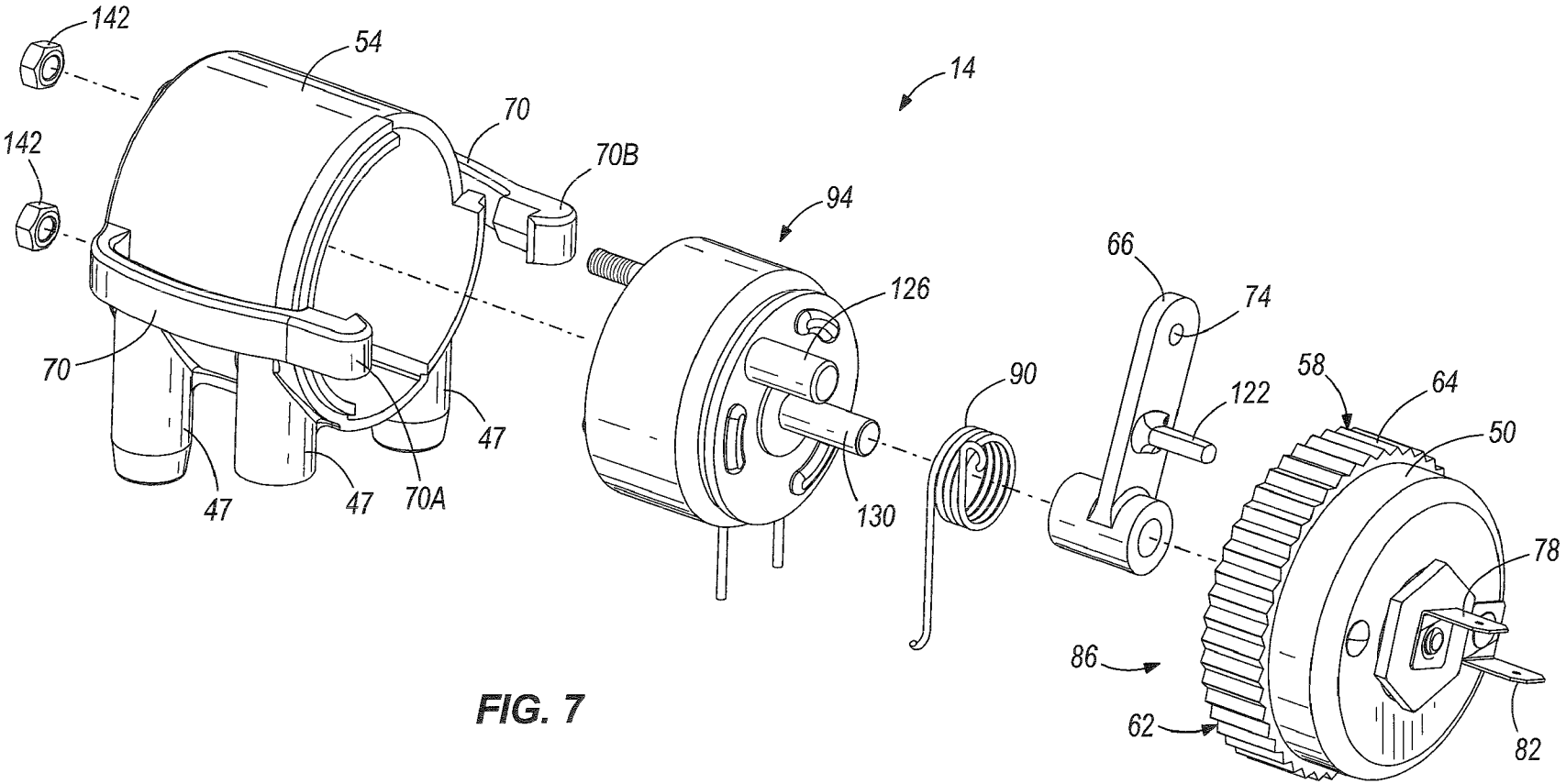
FIG. 7 is an exploded view of the automatic choke module of FIG. 2.
Figure 8:
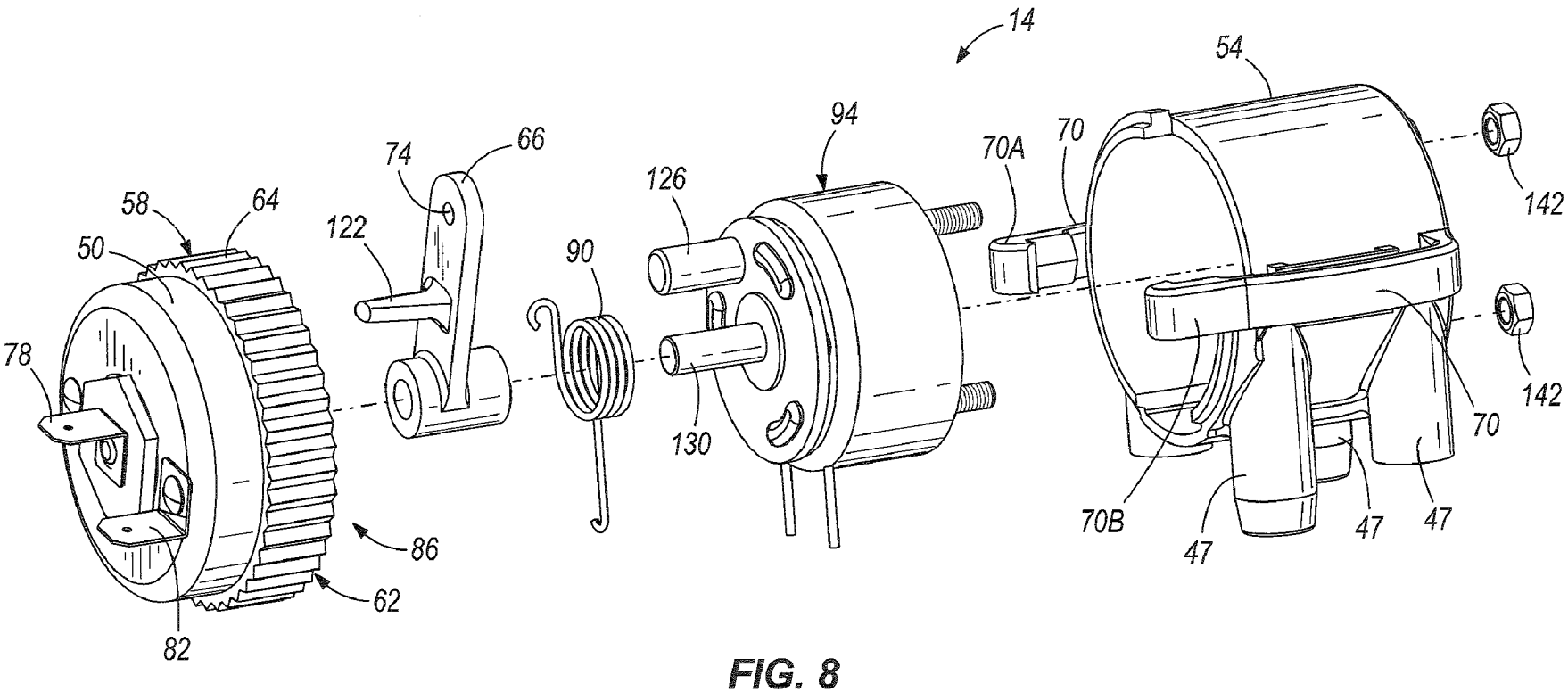
FIG. 8 is another exploded view of the automatic choke module of FIG. 2.

As shown in FIGS. 3 and 4, the automatic choke module 14 includes a choke valve 18 having an axis of rotation 19 and a choke lever 26. In the closed position, the choke valve 18 restricts air flow into the engine, increasing the amount of fuel delivered to the engine during engine starting when the engine is cold (see FIG. 3 with choke valve in a closed position). As the engine warms up, the enriched fuel-air mixture is no longer needed and the choke valve 18 rotates open, allowing more air into the engine (see FIG. 4 with choke valve in an open position). A thermal switch 42, or thermally-responsive snap disk, is mounted in a suitable location on or near the engine to monitor the temperature. The thermal switch 42 is also adapted to open the current path to a rotary solenoid 94 at a desired temperature and further prevents over-enrichment of the engine. The thermal switch 42 can be mounted using any suitable means (e.g., bolt, screw, spot-weld, adhesive, etc.) known to those in the art. The thermal switch 42 is generally located in series with the automatic choke module so that in the event of a hot re-start condition, when the engine does not need full choke to re-start, the circuit is opened to prevent power from engaging and energizing the rotary solenoid 94 during engine cranking via a solenoid wire 93 (shown in FIGS. 2 and 2A and schematically in FIGS. 3 and 4).

With reference to FIGS. 5-10, the automatic choke module 14 includes a module housing 46 that substantially encloses the components of the automatic choke module 14. The choke housing 46 may be manufactured from a variety of materials, including but not limited to, plastic, aluminum, and the like.

The choke housing 46 includes a first housing 50 having a bimetal coil assembly 86, and a second housing 54, the second housing 54 having the rotary solenoid 94. The choke housing 46 has a snap fit retainer mechanism 58. The snap fit retainer mechanism 58 includes an index mechanism 62, which allows rotational motion adjustments in approximately ten degree increments. The index mechanism 62 includes a plurality of spaced notches 64 that engage ends 70A, 70B, respectively, of two opposed arms 70. The index mechanism 62 allows the user to fine-tune the static position of a choke arm 66 position based on ambient conditions and fitment to different engine models.

The first housing 50 and second housing 54 may be held together with arms 70, a fastener 142, a retaining ring, or the like. The arms 70 have a slight curvature configured to locate and hold the bimetal coil assembly 86 onto the module 14. In other embodiments, the arms 70 may be straight or may have a greater curvature. The fasteners 142 are further configured to retain the rotary solenoid 94 in the second housing 54. Alternately, the rotary solenoid and the second housing can be manufactured as an integral piece. The choke housing 46 further includes a plurality of legs 47 to accommodate mounting of the module 14 to the mounting bracket.

The automatic choke module 14 further includes the choke arm 66 that extends above the choke module housing 46 and converts rotational motion into linear motion. In the illustrated embodiments, the choke arm 66 is not directly attached to the output shaft of the rotary solenoid because the illustrated rotary solenoid must always return to its home position after each activation. However, other rotary solenoids may not have this requirement, which may allow the choke lever to be directly attached to the solenoid output shaft.

Figure 12:
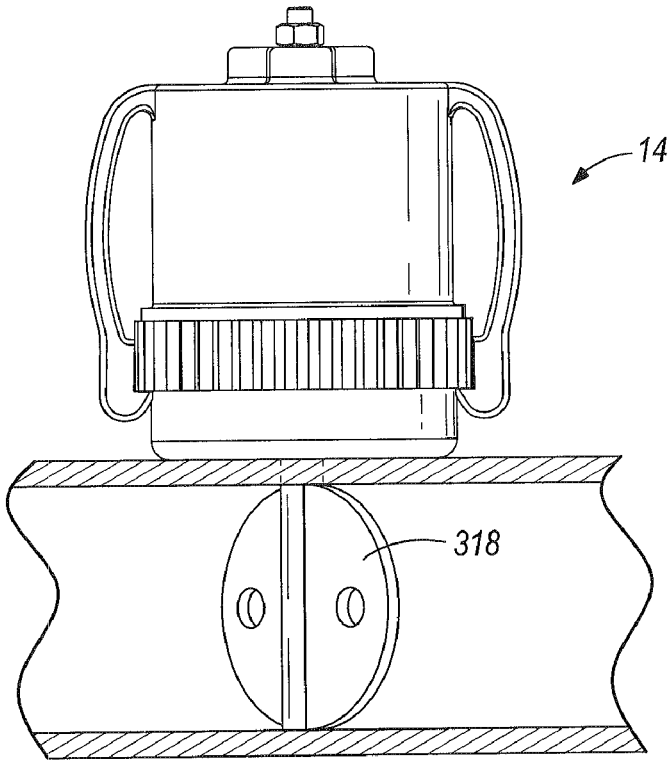
FIG. 12 illustrates another embodiment of an automatic choke embodying the present invention.

The choke arm 66 has a choke arm aperture 74 adapted to receive the choke linkage 22. The choke linkage 22 couples the choke arm 66 to the choke valve 18 via the choke lever 26 (as shown in FIGS. 3 and 4). The choke linkage 22 is shown as a straight rod. However, the choke lever can have another size or shape to accommodate the automatic choke in most engines, thereby further increasing the ability to use the automatic choke module in a variety of engines. In an alternate embodiment, the automatic choke module can directly couple to the choke valve without a choke linkage (see FIG. 12).

The automatic choke module 14 may include a dust cover 30 (FIGS. 2 and 2A) configured to cover a choke arm opening 34 and prevent debris from entering the automatic choke module 14. The dust cover 30 also includes markings 32A, 32B, 32C to indicate the choke arm position. The markings 32A, 32B, 32C provide the operator with visual indications of the choke position. The automatic choke module 14 further includes a spade connector 78 coupled to the first housing 50. The spade connector 78 provides an electrical connection 79 for the automatic choke module 14. The first housing 50 also includes a ground connection 82 having ground wires 83 (shown in FIGS. 2-4). The wires 83, 93 and connection 79 may be coupled to the mounting bracket 38 with fastener clips 91 or similar fasteners. Connectors 84 provide a solid hold for the electrical connections.

Figure 9:
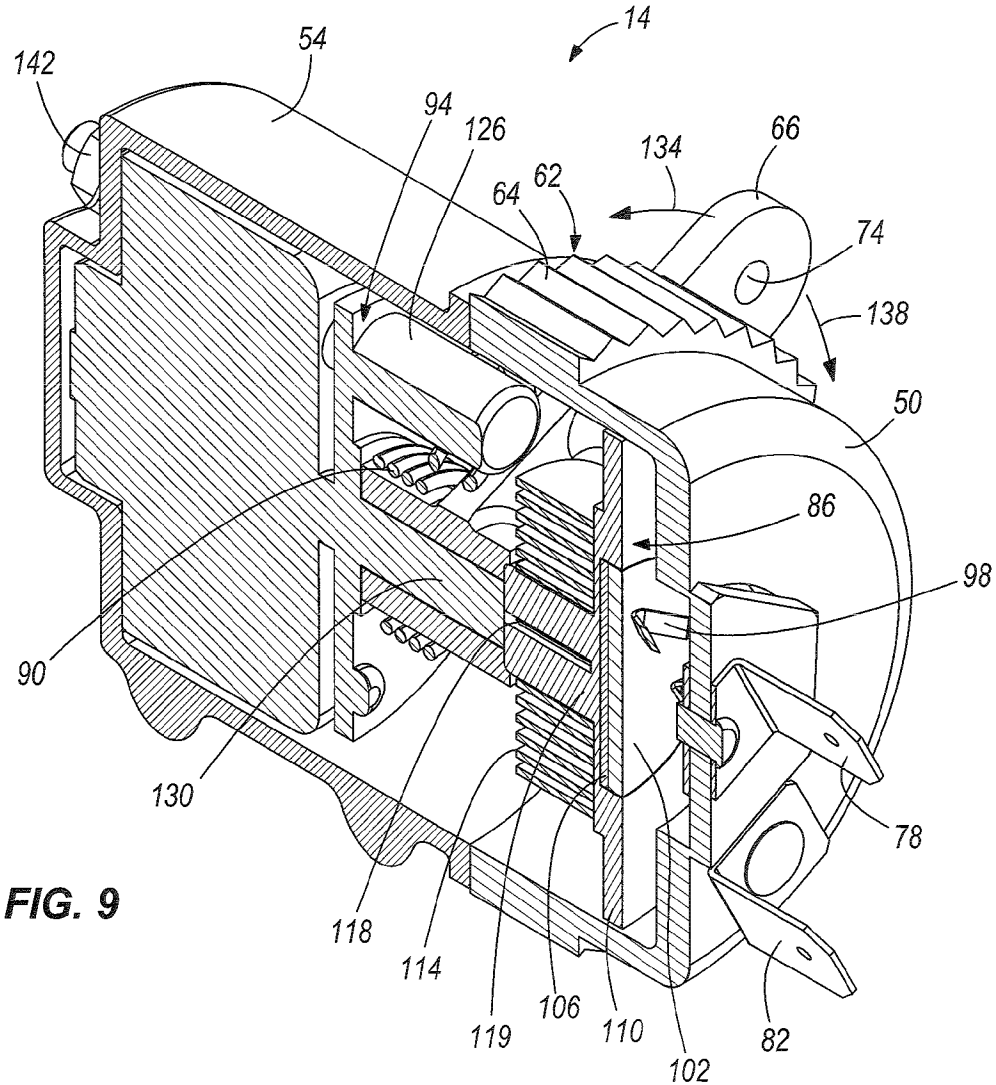
FIG. 9 is a cross-sectional view of the automatic choke module taken along line 9-9 of FIG. 5.
Figure 10:
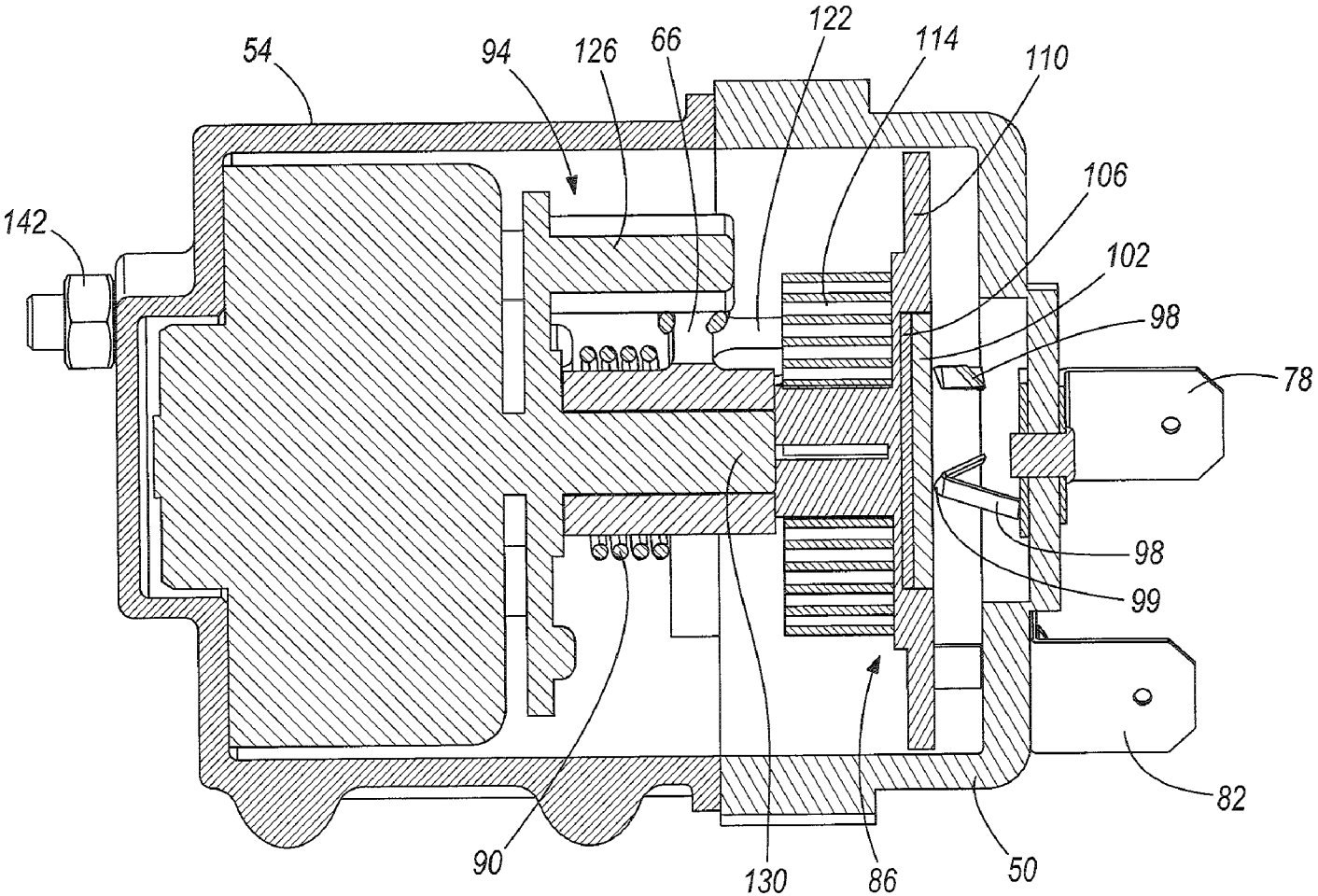
FIG. 10 is another cross-sectional view of the automatic choke module taken along line 9-9 of FIG. 5.

The automatic choke module 14 further includes the bimetal coil assembly 86, a torsion spring 90, and the rotary solenoid 94. As seen in FIGS. 9 and 10, the bimetal coil assembly 86 includes a prong connector 98 (FIG. 9), which transfers energy to the bimetal coil assembly 86 from a battery 87 via a connection 79 (FIG. 3 and 4) to connector 99 to heat a bimetal coil 114. The bimetal coil assembly 86 further includes a first disk 102, a second disk 106, a heat sink 110, and the bimetal coil 114. The first disk 102, or positive-temperature coefficient heater (PTC), is preferably comprised of a ceramic material. However, the first disk may be comprised of other materials with insulator or semi-conductor properties. The resistance and surface temperature of the PTC heater may be changed to vary the amount of energy input to the bimetal coil and vary the engine warm-up choking characteristics accordingly to fine-tune the choking action and time so that the invention may be readily adapted to a variety of engine models. The second disk 106 is preferably graphite, but could be comprised of another material that deforms to make a good contact with the bimetal coil. The heat sink 110 is preferably comprised of aluminum and includes a slot 118 configured to retain one end of the bimetal coil 114. The heat sink 110 further includes a shaft 119 that defines an axis of rotation for the bimetal coil 114. However, the heat sink may be comprised of other materials that sufficiently conduct and dissipate heat like aluminum does. The first disk 102 and second disk 106 aid in heat transfer to the heat sink 110. The bimetal coil 114 is a metallic coil thermally responsive to the PTC heater. The bimetal coil 114 is further engageable with a choke arm lever 122 on the choke arm 66.

The bimetal coil assembly 86 locates the choke arm 66 based on ambient conditions to provide precise choke positioning for acceptable engine warm-up characteristics in all ambient conditions from about −20 degrees Fahrenheit to about 120 degrees Fahrenheit. The PTC heater 102, the graphite disk 106, and heat sink 110 provide thermal energy to the bimetal coil 114, which in turn converts the input energy into rotational motion. Rotational motion relieves the choke to a full open position after engine start-up. The choke arm 66 rotates in a direction indicated by arrow 134 to close the choke valve 18, and in a direction indicated by arrow 138 to open the choke valve 18 (see FIG. 9). The amount of energy needed to accomplish this rotational motion varies due to ambient temperature conditions and the temperature of the engine. For example, in cooler environments or when the engine is cold, the warm-up time for the engine is longer than in warmer environments or during warm engine re-starts because the bimetal coil needs more energy to actuate the choke valve to the open position after engine start-up. For warm or hot re-starts of the engine, the bimetal coil 114 is substantially heated and moves to a position towards open choke, thus allowing the torsion return spring 90 to return the choke lever 26 towards the open choke position. The bimetal coil assembly is configured to provide choking action substantially independent of the engine cooling system and exhaust system.

The automatic choke module 14 further includes the coaxial rotary solenoid 94. The rotary solenoid 94 includes a first rotary solenoid arm or pin 126 and a rotary solenoid shaft 130. The first rotary solenoid arm 126 engages the choke arm 66 when power is supplied to the rotary solenoid 94. The rotary solenoid shaft 130 provides a seat for the torsion spring 90 and further engages the choke arm 66. Slide fitment of the choke arm 66 on the rotary solenoid shaft 130 allows for easy assembly and only allows the choke arm 66 to move rotationally while the rotary solenoid 94 moves both rotationally and axially. The gross starting torque of the rotary solenoid depends on the number of windings in the rotary solenoid. For instance, by design, the gross starting torque at approximately 20 degrees Celsius is approximately 0.046 Newton-meter at a 25 percent duty cycle. A higher duty cycle rating results in an increase in heat and less available torque. The design of the rotary solenoid is based on principles of a linear solenoid, and employs three-ball bearing races (not shown) to convert linear motion into rotary motion. The interaction between the rotary solenoid and the choke arm provides additional solenoid travel to assure the carburetor attains the full choke position during engine starting. The choke arm is designed for approximately forty-three (43) degrees of rotation to actuate the choke valve from the fully-closed choke to open choke position. The rotary solenoid has sixty-seven point five (67.5) degrees of rotation available. The available travel provides that the choke rotation is able to travel, from the fully-closed choke position to the fully-open choke position.

In some embodiments, the rotary solenoid 94 is coaxial with the bimetal coil assembly 86. In other embodiments, the choke arm 66 is also coaxial with the rotary solenoid 94 and the bimetal coil assembly 86. In still other embodiments, a choke valve 318 is coaxial with the automatic choke module 14 having the rotary solenoid 94 and the bimetal coil assembly 86 (see FIG. 12). The coaxial alignment of the bimetal coil 114, the choke arm 66, the rotary solenoid 94, the torsion spring 90, and the housing 46 allows for compact packaging and easy assembly with minimal parts. The compact nature of the automatic choke module contributes to the universality of the automatic choke module and the adaptability of the automatic choke module to be mounted in a plurality of angles and positions. The module may be used with a plurality of engine configurations by simply designing a suitable linkage between the choke arm and the choke lever.

In operation, the thermally conductive materials within the automatic choke module 14 allow the automatic choke module 14 to function as an automatic choke. In general and dependent on ambient temperature, at engine start-up, the choke valve 18 is in the closed position. The warm-up of the engine 10 causes the choke valve 18 to move to the open position. However, the choke lever 26 is not always in the closed position at engine start-up. For instance, at about seventy (70) degrees Fahrenheit, the choke valve is positioned at an approximately half-choke position. In circumstances where the engine 10 is already warm upon start-up, the automatic choke module 14 functions to hold the choke valve 18 in at least a partially open position to prevent an overly-rich fuel-air mixture when the engine 10 does not require such a rich mixture to maintain combustion.

More specifically, when the temperature of the engine 10 is below a certain threshold temperature, the rotary solenoid 94 is energized during engine cranking, such as when an operator moves a momentary start switch 95 to the START position. The energized solenoid pin 126 biases the choke arm 66 to move the choke valve 18 to a closed position. Closing the choke valve 18 reduces the air flow to the engine 10 and enriches the fuel-air mixture. If the engine 10 is above the predetermined threshold temperature, the rich fuel-air mixture is not needed by the engine 10 for engine starting. Above the predetermined threshold temperature, the thermal switch 42 interrupts the electrical power supplied to the rotary solenoid 94. Once the rotary solenoid 94 is de-energized and the momentary switch 95 is released so that it remains in the ON position, the torsion spring 90 holds the choke arm 66 against the bimetal coil 114. As the engine 10 warms up, the bimetal coil 114 winds up and allows the choke arm 66 to rotate to a full open position. Following engine start and subsequent de-energizing of the rotary solenoid 94, the choke arm 66 is positioned by the interplay and opposing forces of the bimetal coil 114 and the return spring 90.

Figure 13A:
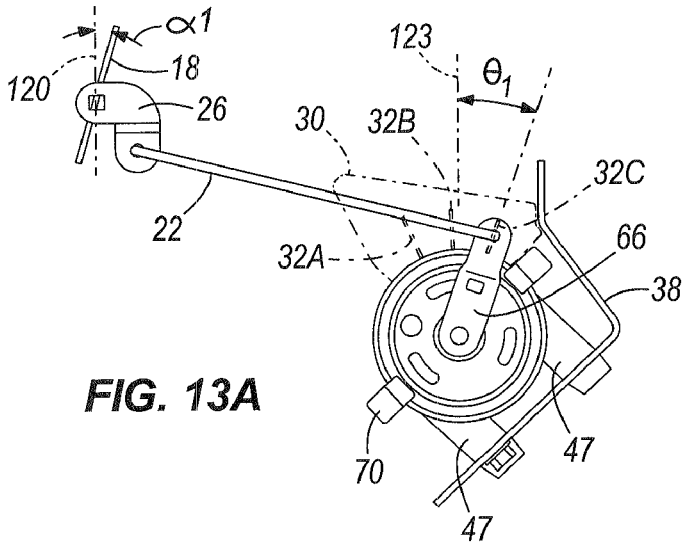
FIGS. 13A-13E are side views illustrating the automatic choke in various operating conditions.

For example, and as shown in FIGS. 13A-13E, the choke arm 66 is operable to move the choke valve 18 to various operating positions. A choke axis 120 defines a vertical choke valve position. An arm axis 123 defines a vertical choke arm position, which also corresponds to marking 32B. FIG. 13A shows a fully closed choke position, where the choke valve 18 is at an angle $\alpha$1 corresponding to approximately 15 degrees from the choke axis 120, and the choke arm 66 is at an angle $\theta$1 corresponding to approximately 18.6 degrees from the arm axis 123 and corresponding to marking 32C.

Figure 13B:
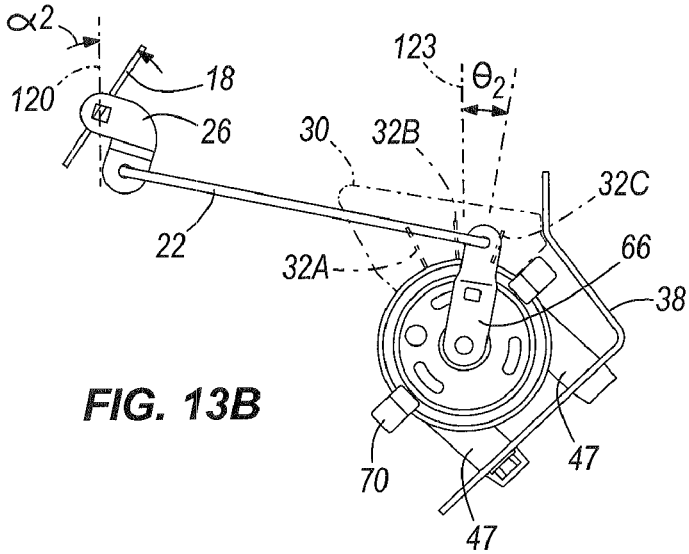
Figure 13C:
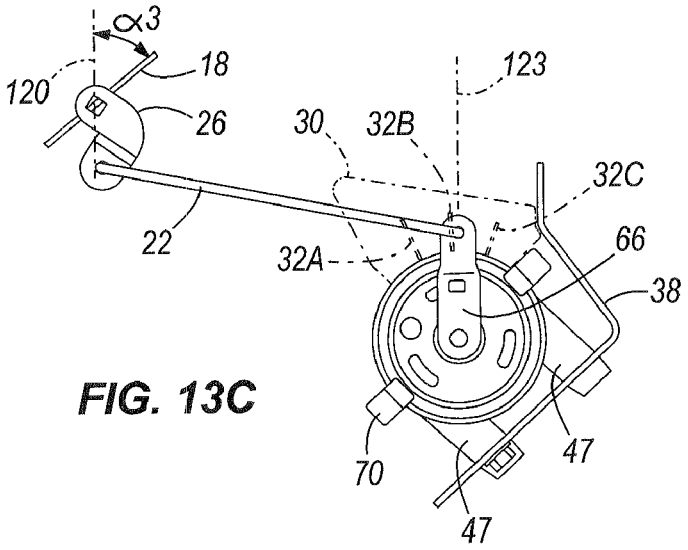
Figure 13D:
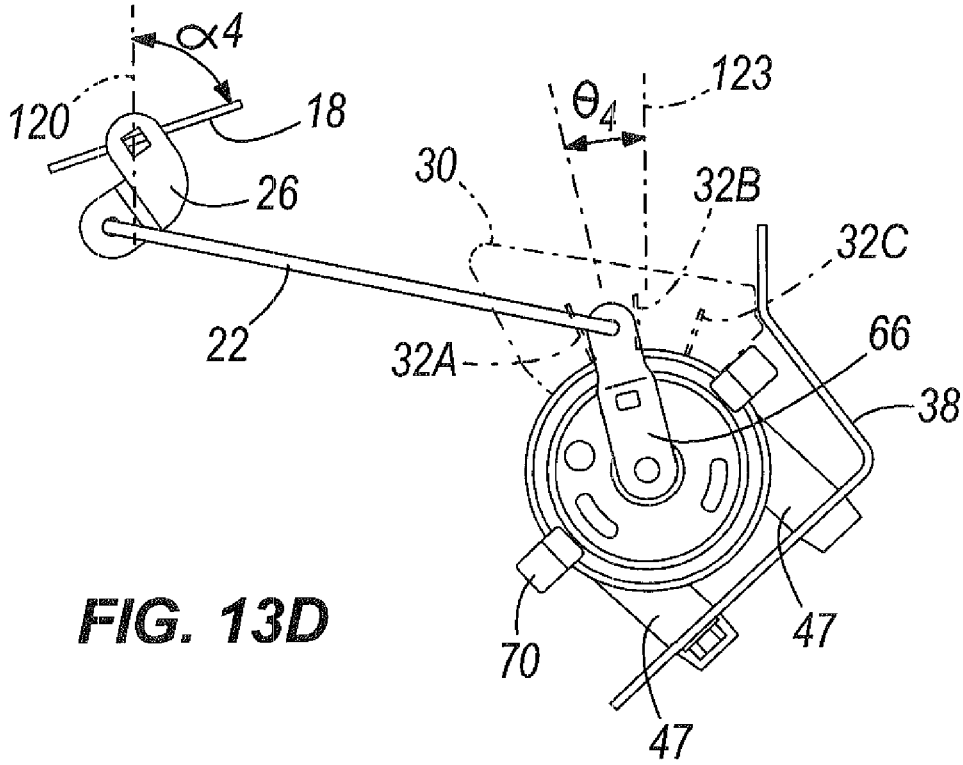
Figure 13E:
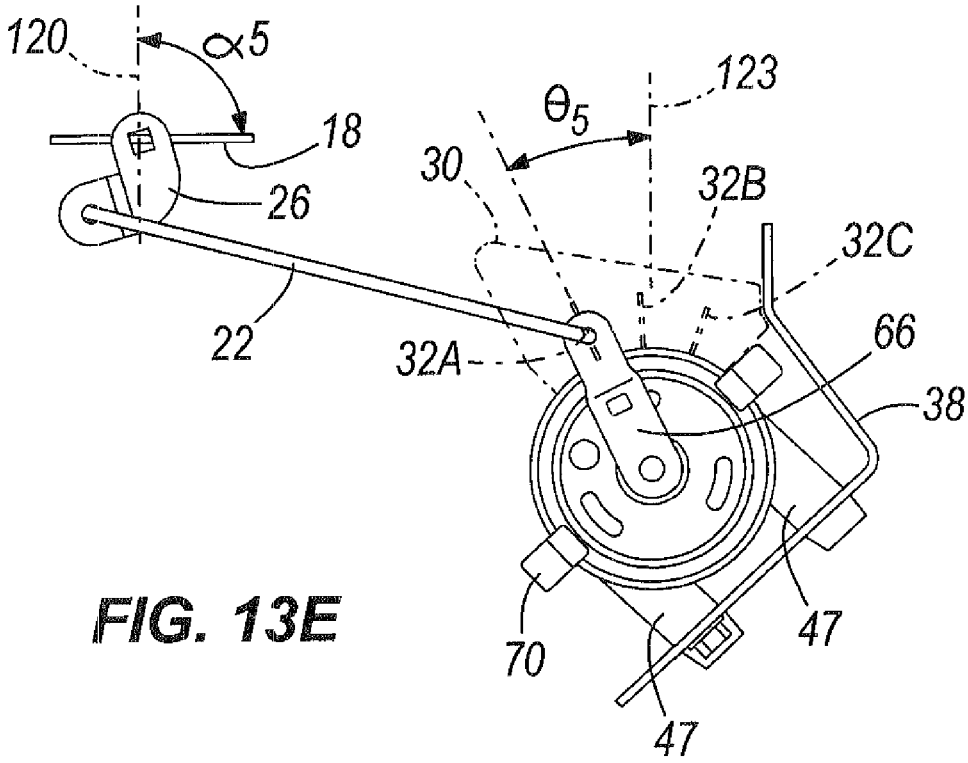

FIG. 13B shows a 75 percent choke closed position, where the choke valve 18 is at angle $\alpha$2 corresponding to approximately 33.75 degrees from the choke axis 120 and the choke arm 66 is at an angle $\theta$2 corresponding to approximately 10.6 degrees from the arm axis 123. FIG. 13C shows a 50 percent choke closed position, where the choke valve 18 is at an angle $\alpha$3 corresponding to approximately 52.5 degrees from the choke axis 120 and the choke arm 66 is at the arm axis 123 corresponding to marking 32B. FIG. 13D shows a 25 percent choke closed position, where the choke valve 18 is at an angle $\alpha$4 corresponding to approximately 71.25 degrees from the choke axis 120 and the choke arm 66 is at an angle $\theta$4 corresponding to approximately negative 11.5 degrees from the arm axis 123. FIG. 13E shows a fully open choke position, where the choke valve 18 is at an angle $\alpha$5 corresponding to approximately 90 degrees from the choke axis 120 and the choke arm 66 is at an angle $\theta$5 corresponding to approximately negative 24 degrees from the arm axis 123 and corresponding to marking 32A.

The automatic choke module may be used with both balanced and unbalanced choking devices. In an unbalanced choke device, additional air flow caused by engaging a load will allow the choke valve to rotate even further open by application of an air flow force transferred through the choke arm against the bimetal coil. This built-in self-relieving action allows the engine to sustain optimal running conditions with and without load during engine warm-up.

To determine the choking requirements and placement of the thermal switch, a profile of the engine is performed. The engine temperature profile will determine the temperature ranges of the choking requirements for the particular engine type. Based on the profile, proper placement of the thermal switch can be determined.

Figure 11:
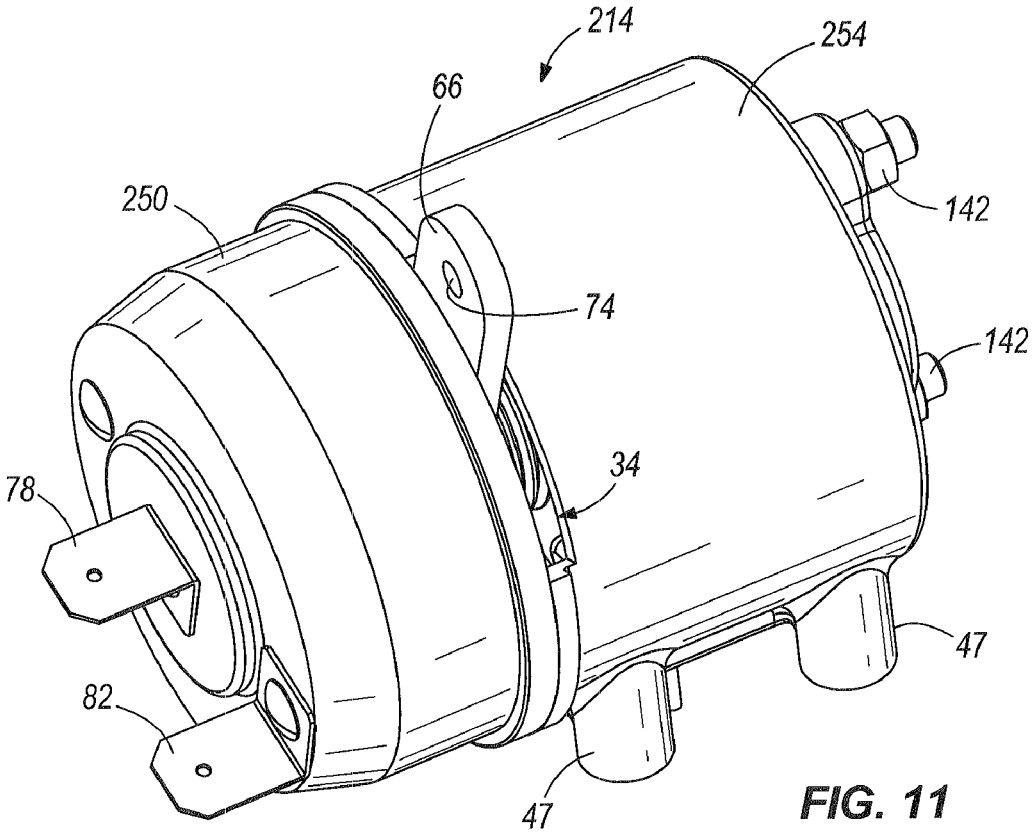
FIG. 11 is an alternate embodiment of the automatic choke embodying the present invention.

FIG. 11 is another alternate embodiment of the automatic choke module 214 according to the present invention. The automatic choke module 214 shown in FIG. 11 includes similar structure to the automatic choke module 14 in illustrated FIGS. 2-10 and 12 described above; therefore, similar components are identified by the same reference numerals. More specifically, the automatic choke module 214 in FIG. 11 does not have the optional index mechanism 62 shown in FIGS. 2-10 and 12. Instead, the first housing 250 and second housing 254 are held together with a snap-fit connection, push-on connection, or similar connection.

Various features and advantages of the invention are set forth in the following claims.

What is claimed is:

1. An engine starting assist system configured to be used on an internal combustion engine, the starting assist system comprising:

a battery;

a choke valve disposed in an air intake of an air/fuel-mixing device, the choke valve having an open position and a closed position;

a rotary solenoid powered by the battery, the rotary solenoid having an output shaft;

a bimetal coil, wherein the output shaft of the rotary solenoid is coaxial with the bimetal coil; and a choke arm encircling and rotatably supported by the output shaft while asymmetrically projecting outwardly from the output shaft, the choke arm being rotatable about the output shaft relative to the output shaft by the bimetal coil.

2. The engine starting assist system of claim 1, further comprising a choke linkage that couples the choke arm to the choke valve.

3. The engine starting assist system of claim 2, further comprising a biasing device configured to engage the choke arm to bias the choke valve toward an open position.

4. The engine starting assist system of claim 1, wherein the choke arm is engageable with the bimetal coil.

5. The engine starting assist system of claim 1, further comprising a housing substantially surrounding at least the rotary solenoid, the bimetal coil, and a portion of the choke arm.

6. The engine starting assist system of claim 5, wherein the housing includes an index mechanism configured to allow static positioning of the choke arm.

7. The engine starting assist system of claim 6, wherein the index mechanism further includes:

a first member having two arms having respective ends; and a second member having a plurality of spaced notches configured to engage the ends of the two arms, wherein at least one of the first member and the second member is rotatable relative to the other of the first member and the second member to reposition the ends of the two arms from a first pair of the plurality of spaced notches to a second pair of the plurality of spaced notches.

8. The engine starting assist system of claim 1, further comprising a cover configured to substantially surround the choke arm to prevent debris from entering the rotary solenoid.

9. The engine starting assist system of claim 8, wherein the cover further includes markings to indicate choke valve positions.

10. The engine starting assist system of claim 1, further comprising:

a heat sink in contact with the bimetal coil; and a heater in contact with the heat sink and configured to influence rotation of the bimetal coil.

11. The engine starting assist system of claim 1, further comprising a thermal switch configured to control operation of the rotary solenoid in response to a temperature of the engine.

12. The engine starting assist system of claim 1, further comprising a thermal member configured to transfer energy to the bimetal coil.

13. The engine starting assist system of claim 1, wherein the choke valve has an axis of rotation that is coaxial with the output shaft of the rotary solenoid.

14. The engine starting assist system of claim 1, wherein the output shaft of the rotary solenoid extends along a first axis, the engine starting assist system further comprising a pin extending along a second axis spaced from the first axis and rotatable by the rotary solenoid about the first axis while the pin is against the choke arm.

15. The engine starting assist system of claim 1 further comprising:

a first member carrying the bimetal coil and rotatable relative to the rotary solenoid;

a plurality of detents associated with one of the first member and the rotary solenoid, the plurality of detents encircling a rotational axis of the output shaft; and at least one projection associated with the other of the first member and the rotary solenoid, wherein the at least one projection is selectively positionable into one of the plurality of detents to retain the bimetal coil relative to the rotary solenoid in one of a plurality of available positions.

16. An automatic choke configured to be used on an internal combustion engine, the automatic choke comprising:

a choke valve disposed in an air intake of an air/fuel-mixing device, the choke valve having an open position and a closed position; and an automatic choke module comprising:

a rotary solenoid powered by a battery, the rotary solenoid having an output shaft;

a bimetal coil assembly including a bimetal coil;

a choke arm;

wherein the output shaft of the rotary solenoid is coaxial with the bimetal coil; and a housing substantially enclosing the automatic choke module, wherein the housing includes an index mechanism configured to allow static positioning of the choke arm, the index mechanism comprising:

two arms having respective ends; and a plurality of spaced notches configured to engage the ends of the two arms.

17. The automatic choke of claim 16, wherein the bimetal coil assembly further comprises:

a heat sink in contact with the bimetal coil; and a heater in contact with the heat sink.

18. The automatic choke of claim 16, wherein the choke arm is coaxial with the output shaft of the rotary solenoid and the bimetal coil.

19. The automatic choke of claim 16, further comprising a choke linkage that couples the choke arm to the choke valve.

20. The automatic choke of claim 16, wherein the choke arm includes a choke arm lever configured to be positioned by opposing forces of the bimetal coil and a biasing device.

21. The automatic choke of claim 16, wherein the automatic choke module further comprises a thermal switch configured to control operation of the rotary solenoid in response to a temperature of the engine.

22. The automatic choke of claim 16, further comprising a cover configured to substantially surround the choke arm to prevent debris from entering the rotary solenoid.

23. The automatic choke of claim 16, wherein the output shaft of the rotary solenoid extends along a first axis, the automatic choke further comprising a pin extending along a second axis spaced from the first axis and rotatable by the rotary solenoid about the first axis while the pin is against the choke arm.

24. The automatic choke of claim 16, wherein the output shaft is coincident with an axis and wherein the plurality of spaced notches circumferentially extend about the axis.

25. An engine starting assist system configured to be used on an internal combustion engine, the starting assist system comprising:

a battery;

a choke valve disposed in an air intake of an air/fuel-mixing device, the choke valve having an open position and a closed position;

a rotary solenoid powered by the battery, the rotary solenoid having an output shaft;

a bimetal coil, wherein the output shaft of the rotary solenoid is coaxial with the bimetal coil;

a choke arm coaxial with the output shaft of the rotary solenoid and the bimetal coil; and a cover configured to substantially surround the choke arm to prevent debris from entering the rotary solenoid, wherein the cover further includes markings to indicate choke valve positions.

* * * * *